US005370568A

United States Patent [19]

Ivins et al.

[11] Patent Number: 5,370,568

[45] Date of Patent: Dec. 6, 1994

[54] CURING OF A TUNGSTEN FILAMENT IN AN ION IMPLANTER

[75] Inventors: Dottie Ivins; Johnny B. Holbrook; Randy J. Holder, all of Palm Bay; Thomas E. Sepanik, Indialantic; Jack W. Jinkins, Palm Bay, all of Fla.

[73] Assignee: Harris Corporation, Melbourne, Fla.

[21] Appl. No.: 30,980

[22] Filed: Mar. 12, 1993

[51] Int. Cl.[5] ..... H01J 9/42

[52] U.S. Cl. ..... 445/3; 445/6; 445/62; 445/63

[58] Field of Search ..... 445/6, 3, 62, 63

[56] References Cited

FOREIGN PATENT DOCUMENTS 4-190537 7/1992 Japan ..... 445/6

*Primary Examiner*—P. Austin Bradley

*Assistant Examiner*—Jeffrey T. Knapp

*Attorney, Agent, or Firm*—Joel I. Rosenblatt

[57] ABSTRACT

Within an ion implanter, a source element or filament may be cured outside of the ion implanter. This may be accomplished within a vacuum chamber using the same source assembly or canister to hold the filament as is used within the ion implanter. The filament within the source canister is inserted into the vacuum chamber and a vacuum is produced at a first set point. Then, the current is gradually increased while monitoring the pressure compared to a second set point. The current is decreased where the second pressure set point is reached to prevent oxidation. Where the chamber pressure is below the second set point, the current is allowed to increase. The curing of the filament is indicated when the filament increases to the third set point, without chamber pressure exceeding the second set point.

10 Claims, 2 Drawing Sheets

CURING OF A TUNGSTEN FILAMENT IN AN ION IMPLANTER

FIELD OF THE INVENTION

This invention is related to the field of ion implant technology and particularly to the preparation of tungsten filaments for use in an ion implanter.

BACKGROUND

An Ion Implanter consists in general of an ion source which ionizes atoms and molecules of solid, liquid, or gaseous feed materials, an electrostatic extraction and pre-acceleration field, an analyzing system where the ions are separated according to their masses, an acceleration system, and a scanning system to distribute the ions uniformly over the target. In addition, vacuum and control systems are necessary for operation.

The ion source typically employs a tungsten filament located within an arc chamber that has orifices for the introduction of gas or vapor atoms and a slit for the extraction of ions. The filament is directly heated by passing an electric current through it. This heating causes thermionic emission of electrons from the surface of the filament. An electric field, typically 30–150 volts, is applied between the filament and the arc chamber. This field accelerates the electrons from the filament area to the arc chamber walls. A magnetic field is introduced perpendicular to the electric field and causes the electrons to spiral outward increasing the path length and chances for collisions with the gas molecules. The collisions break apart many of the molecules and ionize the resultant atoms and molecules by knocking outer shell electrons out of place. As charged particles, these atomic or molecular ions can now be controlled by magnetic and/or electric fields. With one or more electrons missing, the particles carry a net positive charge. An extraction electrode placed in proximity to the slit and held at a negative potential will attract and accelerate the charged particles out of the arc chamber through the slit. An additional electrode biased positive follows the extraction electrode. This electrode is called the decal electrode and together the two perform beam extraction and initial focusing.

The beam, which at this point consists of many types of atoms and molecules, then passes through mass analysis. A properly shaped and oriented magnetic field will bend the path of each type particle a specific amount. Typically, the strength of this field is adjusted so that the desired type particle path is bent 90 degrees. Heavier particles will not make 90 degrees and lighter particles will do more than 90 degrees. Thus, the beam of all particles will be separated into a number of pure beams all following different paths. This system is called the mass analyzer.

Following the mass analyzer is a system of apertures, which allows the desired beam to pass, but blocks all other beams, and a beam shutter to gate the beam off and on at the appropriate times.

At this point, typically another system of electric fields are used to further accelerate and focus the beam. Acceleration potentials of zero to 160,000 volts are used, depending on the desired depth of deposition.

At this point, the beam is pure and sufficiently focused to be used in a system where the beam is fixed and the wafers are scanned in two planes through the beam. This scanning is done so that each area of the wafer is exposed to each area of the beam and nonuniformities in beam density are cancelled out, producing a uniform dose across the wafer.

Other types of systems fix the wafer position and electrostatically scan the beam. These systems require further focusing with an electrostatic lens system and set of X-Y scan plates to achieve the required uniformity.

The entire "beam-line" and ion source of all ion implanters must be maintained at a state of high vacuum during operation. When produced under normal conditions, ions are very short lived. They tend to acquire electrons from other atoms that they constantly come into contact with. Additionally, collisions with other gas molecules will alter the path much the same as a cue ball that strikes another ball along its path. In either case, the results are undesirable.

An expected failure mode within an ionization implanter is failure of the source or filament element. In common terms, the filament element burns out in the manner, in the way a light bulb element burns out during use. Where this "burn-out" failure occurs, the source assembly containing the filament must be removed from the implanter and a new source assembly installed. This process requires releasing the ion implanter vacuum, removing the old source or filament, installing a new filament, and then bringing the implanter back under vacuum and applying power to the filament. Further, restoring the filament requires a curing or "burn-in" time and an out-gassing procedure to release the gasses produced by the initial application of current to the new filament. During this time, as is well known in the art, impurities are driven from the new filament by the heating of the filament. These impurities are released into the machine in the form of a gas. In the process of filament "burn in" or curing, these gases are continuously removed until the cumulative effect of heating the filament to elevated temperatures drives off or causes the removal of the filament impurities. The whole process may take 45 minutes or longer. During this time, the ion implanter machine cannot be used for its intended purpose.

SUMMARY OF THE INVENTION

This invention allows curing or burning-in of the new filament without requiring use of the ion implanter itself. Accordingly, a new source or filament may be cured separate from the ion implanter and be ready for the moment the current filament is burnt out or fails and a new filament is required. In that event, the new filament, already cured can be inserted in the ion implanter and ion implantation the process started immediately.

Within an ion implanter, the source or filament is contained within the source canister or source housing assembly, as is well known. This housing is modular and provides a structure to hold the filament, to apply current to the filament for heating and lenses for focusing the filament beam. The modular source canister housing assembly is removable and insertable as a unit into the source canister housing assembly. Once the source housing assembly is removed, from the implanter, the filament may be extracted and a new filament put in place. However, instead of putting that same source housing canister assembly with the new filament back into the implanter, it is mounted into a separate vacuum chamber and current is applied to the filament. The new filament then may be cured outside of and without occupying the ion implanter by placing the source canister housing assembly with the new filament in a separate vacuum chamber for filament burn-in or cure. The pressures required for the filament burn-in or cure process can be altered from the pressures required in an ion implanter. For example, in the preferred embodiment and according to the principle of the invention, cure or burn-in may be at approximately 20 milliTorr as compared with pressures substantially lower in an ion implanter in the microTorr range.

In the cure process, the source canister housing assembly is inserted in the separate vacuum chamber and a vacuum seal is made. The pressure in the vacuum chamber is reduced to a first set point where the curing process may be started. An increasing current is applied to the filament increasing the filament temperature and increasing the rate which impurities are driven from the filament, in the form of gasses.

As the increasing heated filament produces gasses in the vacuum chamber, the chamber pressure increases to a second set point. This second set point is set below a pressure where oxidation may be expected. When the pressure increases to the second set point, a pressure detector generates a signal reducing the current in the filament, reducing the out-gassing from the filament and the pressure in the chamber and thereby preventing oxidation. Cure of the filament may be continued until maximum filament current is reached without exceeding the second set point indicating completion of the curing process. This curing process may be stopped, at that time, or continued for a short time after depending upon the application to which the filament is placed.

The sequencing of the process and the control of the current vs. pressure may be accomplished by a computer processing unit. For this application, any of the available units may be chosen and programmed as would be accomplished easily with the ordinary level of skill in the art.

In this way, the curing of the process for the filament may be automatically accomplished by controlling the amount of current applied to the filament in relation to the measured pressures within the vacuum chamber and with the benefit of avoiding damage to the filament by oxidation at elevated pressures.

DETAILED DESCRIPTION OF THE INVENTION

Figure 1:
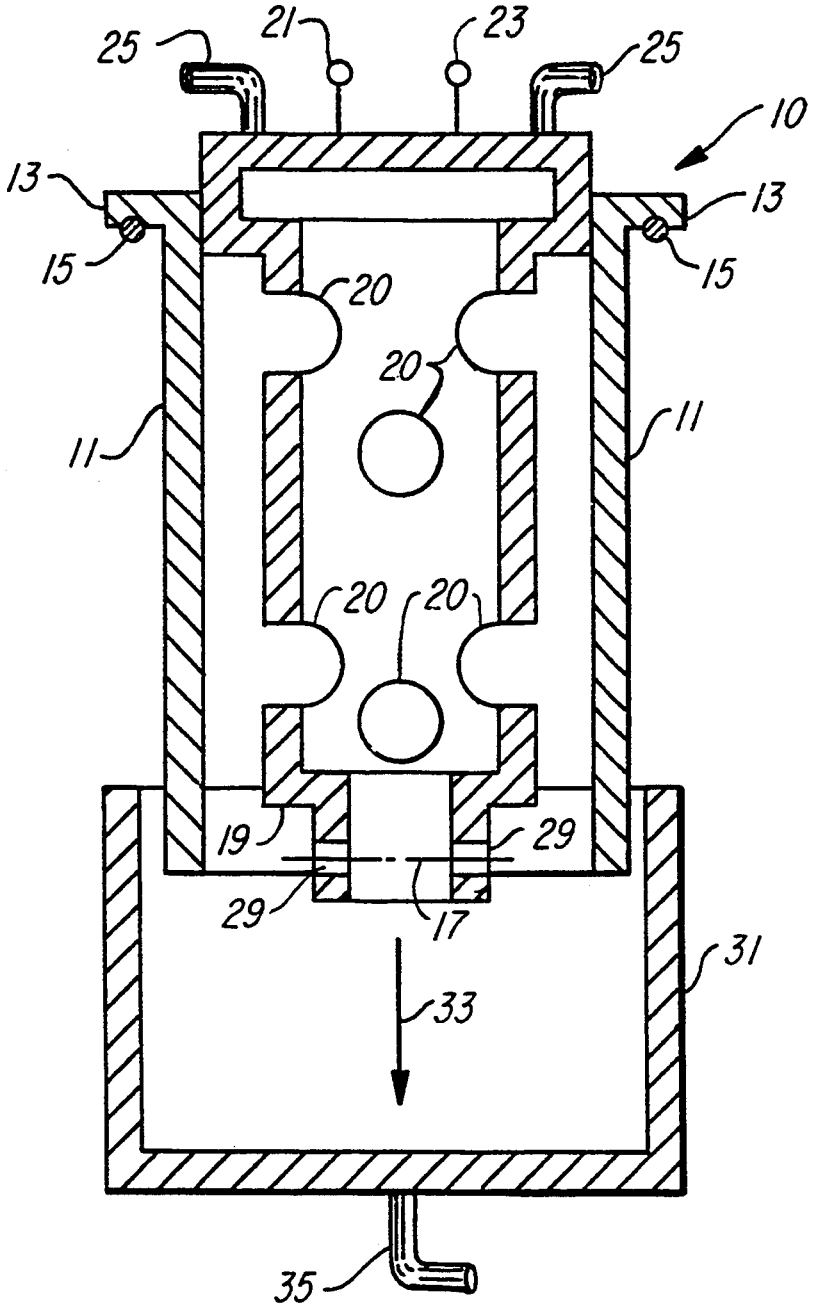
FIG. 1 shows in a representative form a cross-section of a source canister housing assembly supporting a filament and as may be used to practice this invention.

In FIG. 1 the source canister housing assembly as may be used in an ion implanter is represented in cross section approximately by numeral 10. Ion implanters, such as manufactured by Eaton Co., are well known in the art as are the parts such as the source canister housing assembly and for that reason are not shown in detail. As would be known by those skilled in the art, the canister may contain an outer assembly 11 having a flange 13 containing an o-ring 15 for sealing the unit when placed inside the vacuum chamber. The filament or source element is shown held within an inner assembly 19. The filament is connected electrically to terminals 21 and 23. Additionally, input and output conduits 25 and 27 are provided for cooling fluid to cool the filament or source element during the curing process. Further, the filament may be held in nonconductive supports 29. The exact construction of the source canister housing assembly is not shown as it would be apparent to those skilled in the art and can take many different designs depending upon choice. As it does not form part of the invention, it is shown in representative form only. Inner assembly 19 may be configured with vent holes 20 to allow the gasses from the heated filament to freely circulate in the vacuum chamber and be properly exhausted. A vacuum chamber shown as 31 is then employed by inserting the source canister housing assembly 10 in the direction of arrow 33 into the vacuum chamber. The vacuum chamber is shown not to scale and representational as it would be well known to those skilled in the art of how to construct a vacuum chamber adapted to fit and hold the source canister assembly in a relationship allowing a vacuum to be drawn and the gas accumulated in the vacuum chamber during the curing process to be drawn off or expelled from the chamber. Accordingly, the exhaust line is shown schematically by numeral 35.

Figure 2:
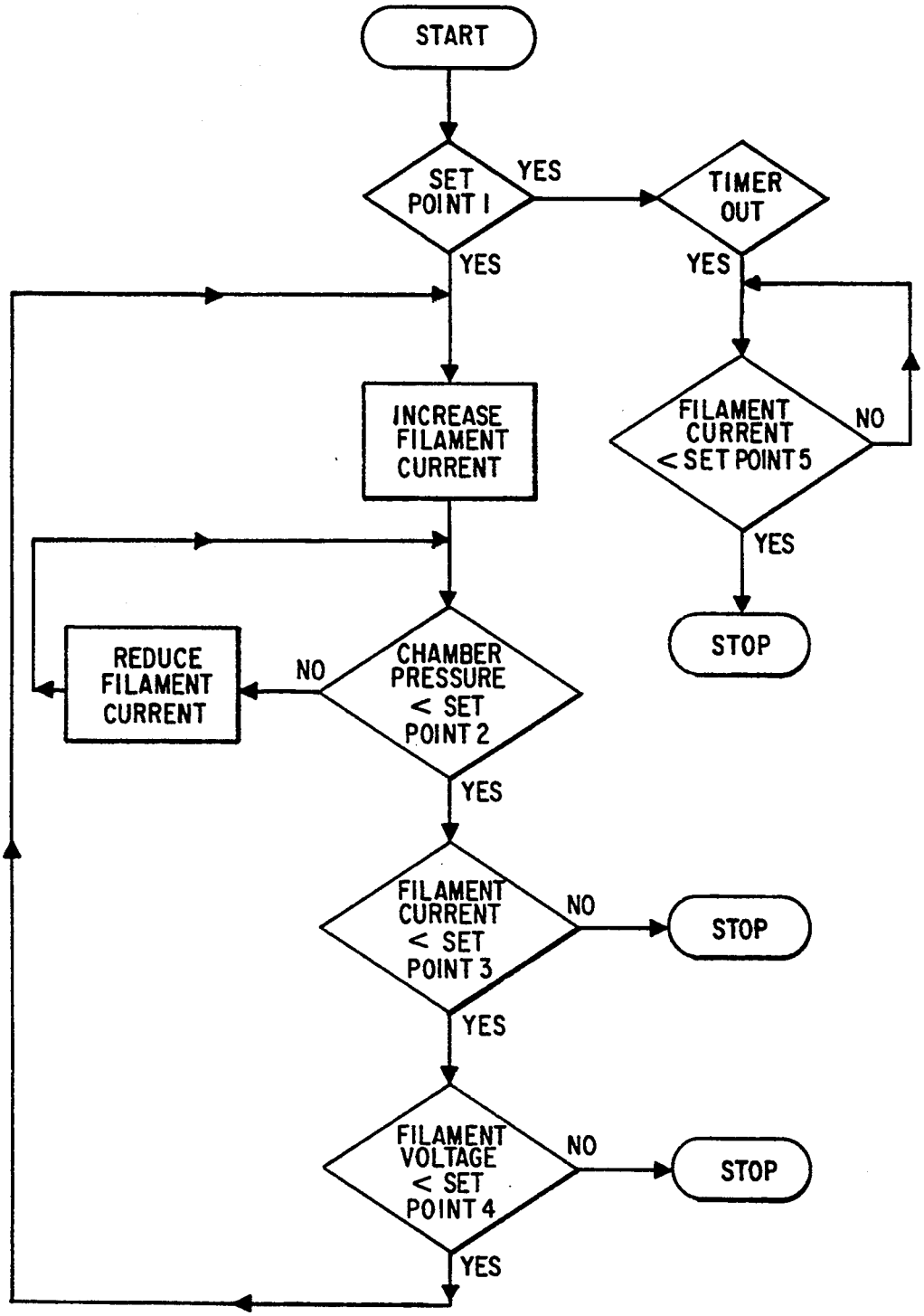
FIG. 2 shows a flow chart for the curing process according to the inventive principles.

The curing process according to the inventive principles is shown by the flow chart of FIG. 2. Initially, the vacuum is started after the source canister housing assembly 10 is inserted into vacuum chamber 31 reducing pressure to a first set point suitable for starting the cure process. The first set point, Set Point 1, in the preferred embodiment, is approximately 20 milliTorr. As soon as that Set Point 1 has been reached, current is applied and gradually increased to the filament.

In the preferred embodiment, the current is increased gradually. The use of the gradually increasing current and heating of the filament allows the different contaminants to be driven from the filament at different times. It prevents the chamber from being overloaded with too rapid an increase and accumulation of gasses and an excessive pressure which may cause oxidation of the filament.

At the same time, the chamber pressure is monitored with reference to a second set point at a higher pressure. If the chamber pressure is less than the second set point, Set Point 2, the current to the filament is increased with the chamber pressure continually monitored with reference to pressure Set Point 2. If the chamber pressure reaches Set Point 2, the filament current is reduced to reduce chamber pressure. At the same time the chamber pressure is monitored with reference to Set Point 2.

According to the inventive process, as long as the chamber pressure is less than Set Point 2, the filament current will be allowed to increase eventually reaching current Set Point 3. The filament current will reach Set Point 3 when the chamber pressure is less than Set Point 2. When this occurs, the filament will have been cured or is approaching a fully cured condition. Accordingly, depending on the uses of the filament or the materials or construction of the filament, the process may be continued for a time thereafter or the process may be stopped.

In the preferred embodiment, the chamber pressure is brought to approximately 20 milliTorr as Set Point 1. Approximately 80 milliTorr is used as Set Point 2 in the preferred embodiment providing a margin of safety with regard to a higher pressure at which oxidation of the filament will occur. In operation of the process, the chamber pressure equal to Set Point 2 may be reached at approximately 25 amps. filament current. As the process continues and when the chamber pressure is below Set Point 2, filament current is allowed to increase to approximately 65 amps. At this current level, in the preferred embodiment, it has been found that the impurities have been driven from and exhausted or out-gassed from the source assembly and the process is complete.

According to the inventive principles, the curing may be accomplished in milliTorr range as compared to curing the filament within an ion implanter in the microTorr range. Further, a filament can be ready for use as soon as needed, thereby releasing the ion implanter for its intended use. Further, the process may be automatically controlled by means of a suitable computer processing unit as would be known to those skilled in the art. This automatic control permits a closer relationship to be maintained between the current increasing in the filament and the chamber pressure due to the out-gassed impurities driven from the filament. Further, the chamber pressure may be more easily maintained at a lower pressure preventing oxidation which will occur at a higher pressure.

Further, in accordance with the inventive principles, a fourth set-point, Set Point 4, may be established in terms of the source element or filament voltage. The actual filament voltage may be compared with voltage Set Point 4 when the filament current is below Set Point 3. As would be apparent to those skilled in the art, a high resistive or broken filament will cause an elevated filament voltage. Where that voltage exceeds Set Point 4, for example, approximately 4.2 volts in the preferred embodiment, a defective filament may be indicated. In this case, the process may be stopped and filament replaced.

Filament current in addition to being monitored with respect to its proximity to Set Point 3, may be monitored to detect a defective filament. Such would be the case where the filament is open or resistive producing a low current. As showed in the preferred embodiment according to the inventive principles, Set Point 5 representing a minimum current is established and compared to actual filament current. Where that filament current is less than current Set Point 5, approximately 65 amps in the preferred embodiment, the process would be stopped and the filament replaced. As any number of suitable devices such as a timer may be employed to delay the application of current Set Point 5 until after the process has started and current has been elevated from its initial zero position to a level higher than Set Point 5.

Any well known and available transducer and computer apparatus for sensing actual voltages and current, pressures for comparison with actual voltages, pressures, and currents and producing alarms or command signals in response to such comparisons may be used. These devices are well-known and are not disclosed as not forming part of the invention.

The inventive concepts here are not limited to the preferred embodiment or the operating ranges shown or described, it being understood by those skilled in the art that this invention would be useful in connection with different chambers and filaments and requiring different pressures, or currents or voltages and could equally be applied where temperature is a critical measurement.

We claim:

1. An apparatus for curing a filament used in an ion implanter comprising a vacuum chamber and a source housing assembly for holding said element;

a means for connecting electrical current to said filament to produce a filament current;

said vacuum chamber having a receiving means for receiving said source housing assembly, said source housing assembly having sealing means cooperating said vacuum chamber for sealing the said source housing assembly within said vacuum chamber;

vacuum means for reducing the vacuum chamber pressure to a first set point;

monitoring means for monitoring said vacuum chamber pressure with reference to a second set point; and means for monitoring said filament current with reference to a third set point; and controlling means responsive to said monitoring means and including means for starting said vacuum source to bring said vacuum chamber pressure to said first set point; means for increasing said filament current and for comparing said vacuum chamber pressure with said second set point, means for reducing said filament current when said vacuum chamber pressure is equal to or above said second set point or continuing to increase said filament current where said vacuum chamber pressure is less than said second set point, and means comparing said filament current to said third set point, and stopping said curing process when said filament current is equal to or greater than said third set point.

2. The apparatus of claim 1 including;

means for monitoring the filament voltage with reference to a fourth set point; said controlling means including means for stopping said process when said filament voltage is greater than said fourth set point.

3. The apparatus of claim 1 including;

means for monitoring said filament current with reference to a fifth set point established at a current level substantially lower than said third set point;

controlling means including means for stopping said curing process when said filament current is less than said fifth set point.

4. The apparatus of claim 3 wherein;

said controlling means including timing means and said means for stopping said process includes means responsive to said timing means and to said filament current for stopping said process when said current is less than said fifth set point for a definite time.

5. A process for curing an ion implanter source element, outside the ion implanter chamber by using the ion implanter source assembly, comprising:

A. removing the source assembly from the ion implanter chamber;

B. removing the source element from the source assembly and installing a new source element;

C. placing said source assembly in a vacuum chamber separate from said ion implanter chamber;

D. creating a vacuum seal between said source assembly and said separate vacuum chamber;

E. creating a vacuum in said separate vacuum chamber;

F. applying current to said source element;

G. maintaining said current to said source element, until said source element is cured.

6. The method for claim 5, including the step of creating a vacuum at a pressure higher than used in said ion implanter.

7. The process of claim 5 including the step of:

comparing said monitored source element current to a set point source element current and stopping said curing process when said monitored source element current is equal to or greater than said set point source element current.

8. The process of claim 5 including the steps of:

monitoring said filament voltage and comparing said filament voltage to a set point filament voltage; and stopping said process when said monitored filament voltage is greater than said set point filament voltage.

9. The method of claim 5 including the steps of:

monitoring the vacuum pressure in said separate vacuum pressure chamber;

comparing said monitored vacuum pressure with a set point vacuum pressure;

monitoring the current to said source element and reducing said current to said source element when said monitored vacuum pressure is greater than said set point vacuum pressure.

10. The process of claim 9 including the step of:

comparing said monitored source element current to a set point minimum source element current and stopping said process when said source element current is less than said set point minimum source element current after an initial starting interval.

* * * * *